US011259987B1

(12) United States Patent
Chen

(10) Patent No.: US 11,259,987 B1
(45) Date of Patent: Mar. 1, 2022

(54) FEMALE MASTURBATION DEVICE

(71) Applicant: Nachuan Chen, Shenzhen (CN)

(72) Inventor: Nachuan Chen, Shenzhen (CN)

( * ) Notice: Subject to any disclaimer, the term of this patent is extended or adjusted under 35 U.S.C. 154(b) by 0 days.

(21) Appl. No.: 17/367,448

(22) Filed: Jul. 5, 2021

(30) Foreign Application Priority Data

Jun. 8, 2021 (CN) ..... 202121282994.2

(51) Int. Cl.
*A61H 19/00* (2006.01)
*A61H 23/02* (2006.01)

(52) U.S. Cl.
CPC ..... *A61H 19/34* (2013.01); *A61H 23/0263* (2013.01); *A61H 2201/149* (2013.01); *A61H 2201/169* (2013.01); *A61H 2205/087* (2013.01)

(58) Field of Classification Search
CPC ..... A61H 19/34; A61H 23/0263; A61H 2201/169; A61H 2205/087; A61H 2201/149
See application file for complete search history.

(56) References Cited

U.S. PATENT DOCUMENTS

2014/0096786 A1* 4/2014 Nuzzo ..... A61K 8/891 132/207
2019/0015291 A1* 1/2019 Sedic ..... A61H 1/00
2020/0360222 A1* 11/2020 Haddock DiCarlo . A61H 19/44

FOREIGN PATENT DOCUMENTS

CN 108578201 A * 9/2018 ..... A61H 39/007

OTHER PUBLICATIONS

English Translation for CN-108578201-A (Year: 2018).*

* cited by examiner

*Primary Examiner* — Quang D Thanh

(57) ABSTRACT

The present disclosure provides a female masturbation device for improving sexual experience. The female masturbation device includes a housing. A cavity is arranged on the housing. A vibrating diaphragm is arranged on a bottom portion of the cavity. The vibrating diaphragm is fixedly connected to the bottom portion of the cavity or is integrally formed with the bottom portion of the cavity. A vibrating driving mechanism is arranged inside the housing. The vibrating driving mechanism is configured to drive the vibrating diaphragm to reciprocate. A swinging head is formed on the vibrating diaphragm. The swinging head extends along a direction of an opening of the cavity.

7 Claims, 8 Drawing Sheets

FEMALE MASTURBATION DEVICE

TECHNICAL FIELD

The present disclosure relates to a field of masturbation device technology, and in particular to a female masturbation device.

BACKGROUND

A female masturbation device is an adult product configured to massage female genitals to help women obtain sexual pleasure. Conventional female masturbation devices are generally mechanical vibration masturbators, such as love eggs. The vibration intensity of this type of equipment is relatively high, which brings a strong sense of discomfort, and user experience is not good.

SUMMARY

Technical problems to be solved by the present disclosure is to provide a female masturbation device that applies a sucking action to a female genital by changing air pressure and simultaneously uses a swinging head to move the female clitoris to improve sexual experience in view of deficiencies of the prior art.

To solve the above technical problems, the present disclosure adopts following technical solutions.

The present disclosure provides a female masturbation device for improving sexual experience. The female masturbation device comprises a housing. A cavity is arranged on the housing. A vibrating diaphragm is arranged on a bottom portion of the cavity. The vibrating diaphragm is fixedly connected to the bottom portion of the cavity or is integrally formed with the bottom portion of the cavity. A vibrating driving mechanism is arranged inside the housing. The vibrating driving mechanism is configured to drive the vibrating diaphragm to reciprocate. A swinging head is formed on the vibrating diaphragm. The swinging head extends along a direction of an opening of the cavity.

Optionally, a diaphragm pressing plate is fixed in the housing. The diaphragm pressing plate is pressed against an edge of the vibrating diaphragm to fix the vibrating diaphragm to the bottom portion of the cavity.

Optionally, an outer side of the housing is wrapped with a soft rubber sleeve.

Optionally, a first cavity recessed inward is formed on the soft rubber sleeve. A second cavity is formed between the housing and the vibrating diaphragm. The first cavity is communicated with the second cavity to form the cavity.

Optionally, a first inner ring protruding inward is formed on a bottom portion of the first cavity. A second inner ring protruding inward toward the second cavity is formed on the housing. The first inner ring abuts against the second inner ring. The swinging head sequentially passes through the second inner ring and the first inner ring. A gap is formed between the swinging head and the second inner ring and the first inner ring.

Optionally, the vibrating disc is formed at a center of a bottom portion of the vibrating diaphragm. The swinging head is close to an edge of the vibrating disc.

Optionally, the swinging head is inclined at a predetermined angle with respect to the vibrating diaphragm.

Optionally, the vibrating driving mechanism comprises a vibrating motor. An eccentric wheel is arranged on an output shaft of the vibrating motor. A connecting arm is formed on a back side of the vibrating disc. The connecting arm is sleeved on the eccentric wheel and is closely connected with the eccentric wheel. When the vibrating motor is running, the eccentric wheel drives the connecting arm and the vibrating diaphragm reciprocate.

Optionally, a silicone sleeve is sleeved on an outer side of the housing. The silicone sleeve is recessed toward the housing to form the cavity. The vibrating diaphragm is integrally formed with the bottom portion of the cavity.

Optionally, a convex ring protruding outward is formed on an edge of the opening of the cavity.

In the female masturbation device of the present disclosure, the vibrating driving mechanism is arranged inside the housing, the cavity is arranged on the housing, and the vibrating diaphragm is arranged on the bottom portion of the cavity. When the vibrating driving mechanism is operating, the vibrating diaphragm is driven to reciprocate, so that a volume of the cavity is repeatedly changed, which in turn brings about repeated changes in air pressure, When the cavity is inverted on the female genital, the repeatedly changing air pressure produces a sucking effect on the human body, thereby realizing a function of sucking and masturbating. Furthermore, the present disclosure provides the swinging head arranged on the vibrating diaphragm, so when the vibrating diaphragm reciprocates, the swinging head swings and repeatedly contacts the female clitoris, which mimics a process of tongue licking the clitoris and helps to enhance sexual pleasure of female masturbation. Based on the above working principle, it can be seen that compared with the prior art, the present disclosure can not only perform sucking action on the female genital by changing the air pressure, but also use the swinging head to move the female clitoris, so that the female masturbation experience is greatly improved, and needs of female users and market demand are met.

DETAILED DESCRIPTION

Figure 1:
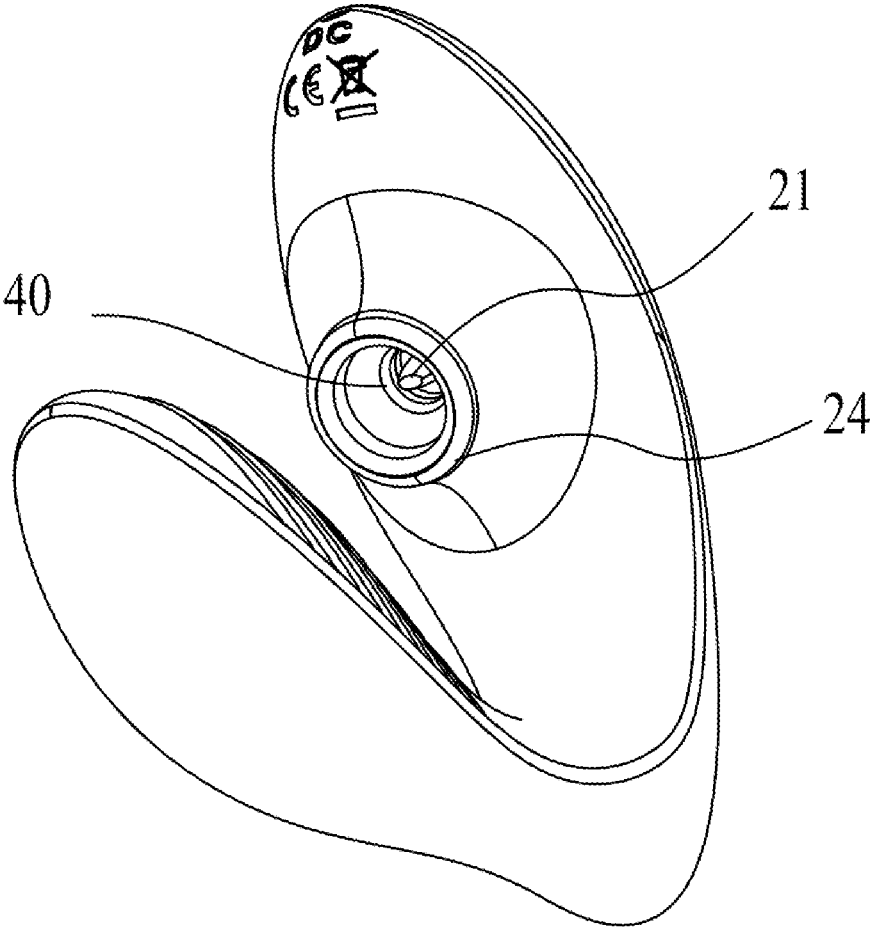
FIG. 1 is a perspective view of a female masturbation device of the present disclosure.
Figure 2:
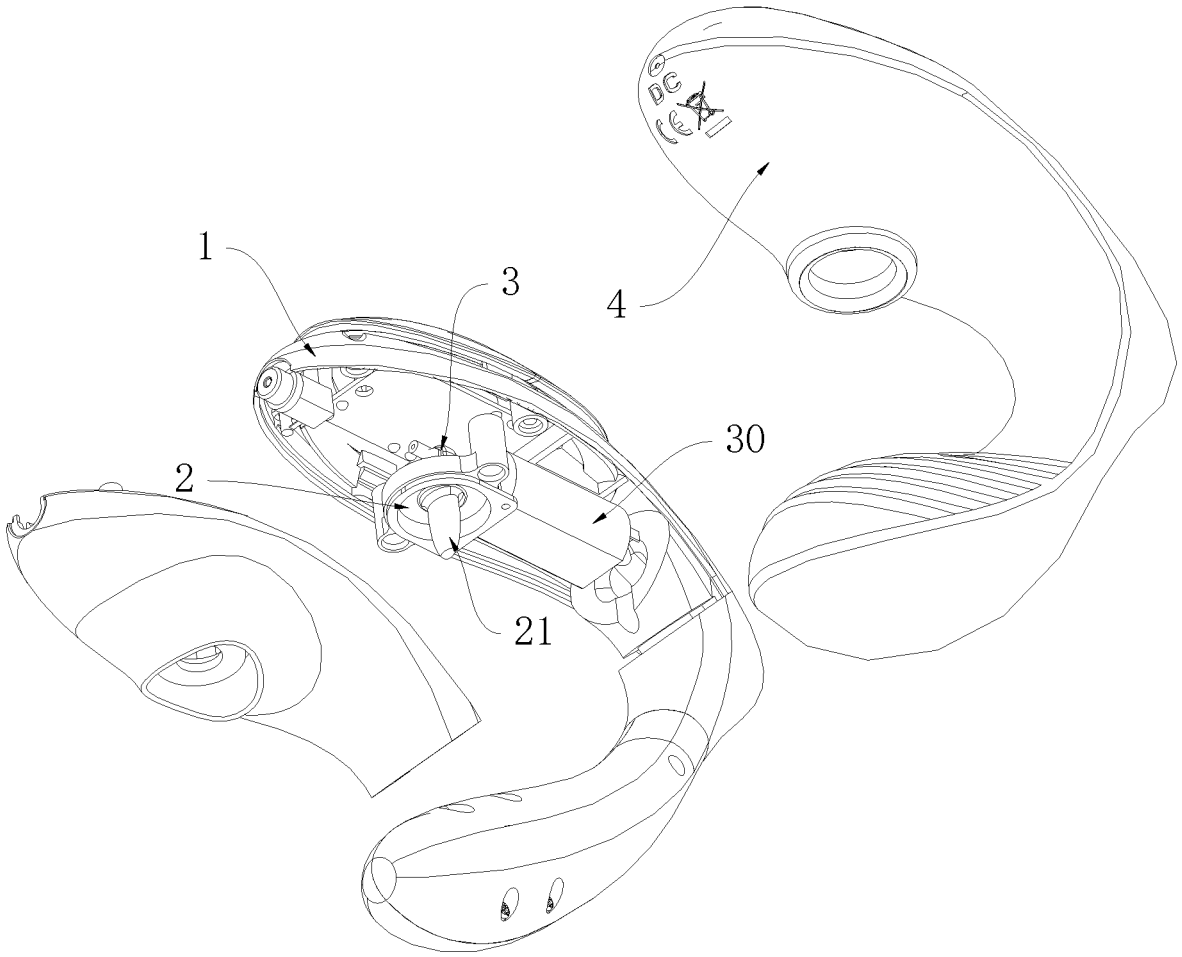
FIG. 2 is an exploded perspective view of the female masturbation device of the present disclosure.
Figure 3:
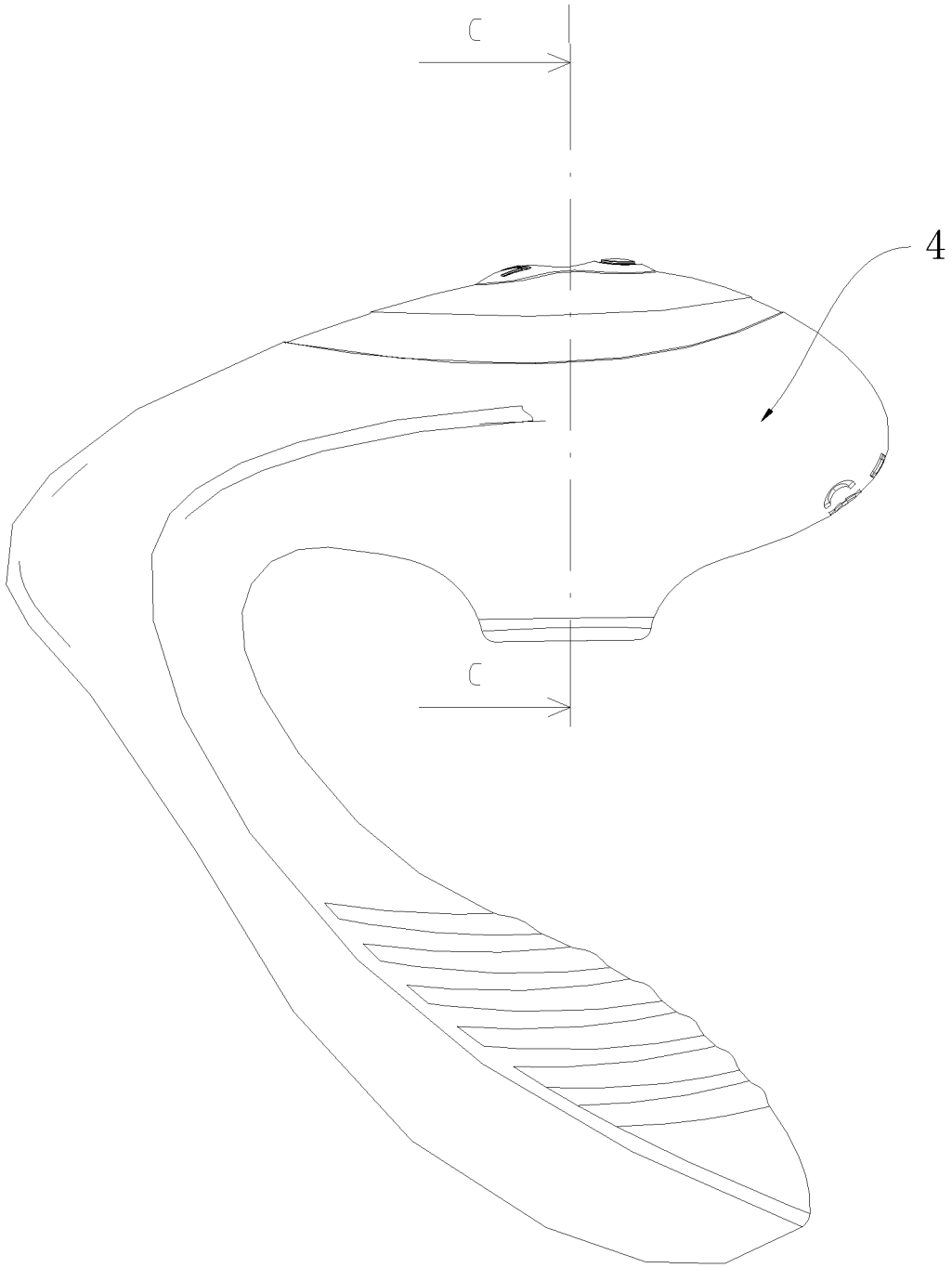
FIG. 3 is a side view of the female masturbation device of the present disclosure.
Figure 4:
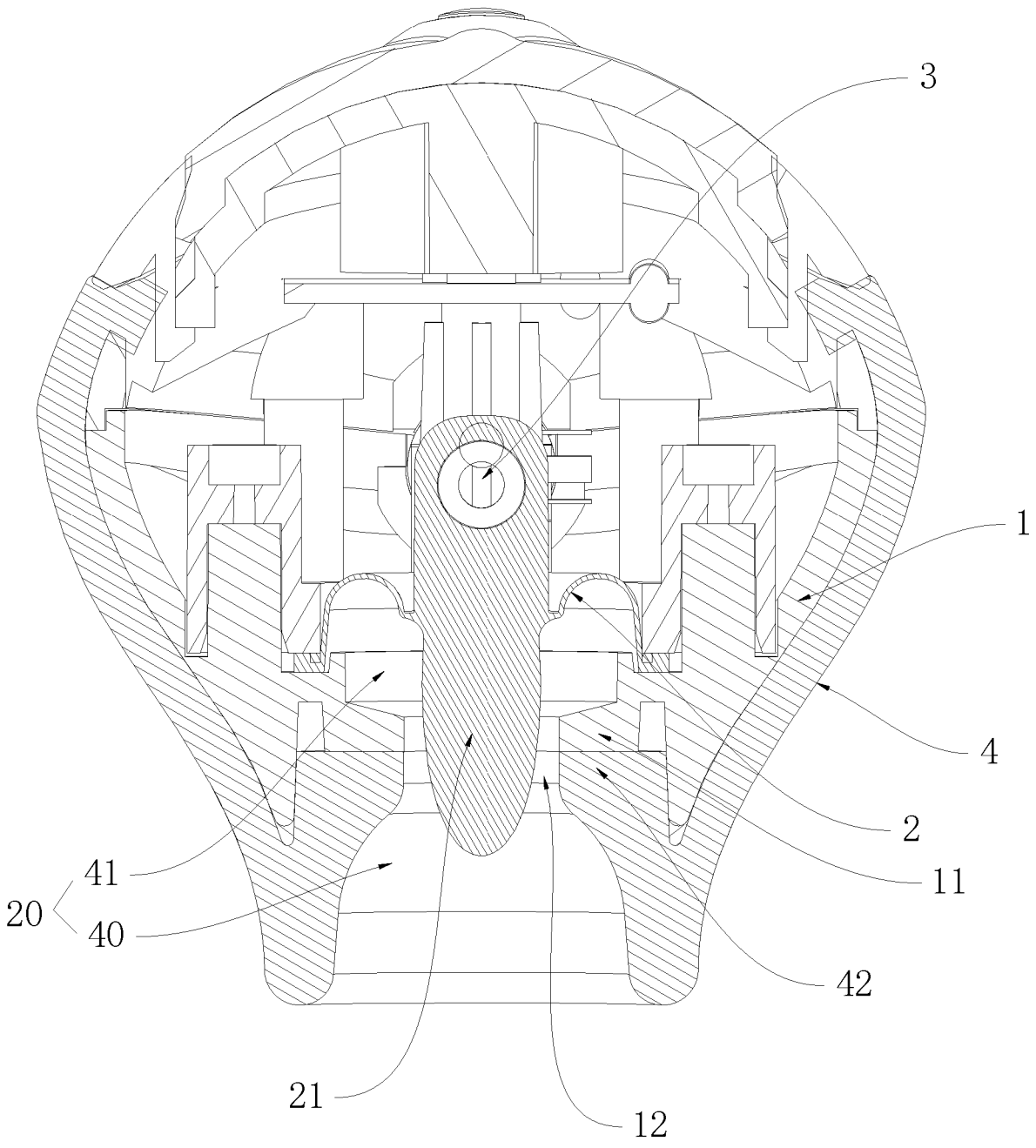
FIG. 4 is a cross-sectional view taken along a line C-C shown in FIG. 3.

The present disclosure will be described in detail below in conjunction with the drawings and embodiments.

As shown in FIGS. 1-4, the present disclosure provides a female masturbation device for improving sexual experience. The female masturbation device comprises a housing 1. A cavity 20 is arranged on the housing 1. A vibrating diaphragm 2 is arranged on a bottom portion of the cavity 20. The vibrating diaphragm 2 is fixedly connected to the bottom portion of the cavity 20 or is integrally formed with the bottom portion of the cavity 20. A vibrating driving mechanism 3 is arranged inside the housing 1. The vibrating driving mechanism 3 is configured to drive the vibrating diaphragm 2 to reciprocate. A swinging head 21 is formed on the vibrating diaphragm 2. The swinging head 21 extends along a direction of an opening of the cavity 20.

In the female masturbation device of the present disclosure, the vibrating driving mechanism 3 is arranged inside the housing 1, the cavity 20 is arranged on the housing 1, and the vibrating diaphragm 2 is arranged on the bottom portion of the cavity 20. When the vibrating driving mechanism 3 is operating, the vibrating diaphragm 2 is driven to reciprocate, so that a volume of the cavity 20 is repeatedly changed, which in turn brings about repeated changes in air pressure, When the cavity 20 is inverted on the female genital, the repeatedly changing air pressure produces a sucking effect on the human body, thereby realizing a function of sucking and masturbating. Furthermore, the present disclosure provides the swinging head 21 arranged on the vibrating diaphragm, so when the vibrating diaphragm 2 reciprocates, the swinging head 21 swings and repeatedly contacts the female clitoris, which mimics a process of tongue licking the clitoris and helps to enhance sexual pleasure of female masturbation. Based on the above working principle, it can be seen that compared with the prior art, the present disclosure can not only perform sucking action on the female genital by changing the air pressure, but also use the swinging head to move the female clitoris, so that the female masturbation experience is greatly improved, and needs of female users and market demand are met.

In order to fix the vibrating diaphragm, in the embodiment, a diaphragm pressing plate 5 is fixed in the housing 1. The diaphragm pressing plate 5 is pressed against an edge of the vibrating diaphragm 2 to fix the vibrating diaphragm 2 to the bottom portion of the cavity 20.

In one optional embodiment, an outer side of the housing 1 is wrapped with a soft rubber sleeve 4.

In the embodiment, the cavity 20 adopts a structure in which a front cavity and a rear cavity are communicate with each other. Specifically, a first cavity 40 recessed inward is formed on the soft rubber sleeve 4. A second cavity 41 is formed between the housing 1 and the vibrating diaphragm 2. The first cavity 40 is communicated with the second cavity 41 to form the cavity 20.

Furthermore, a first inner ring 42 protruding inward is formed on a bottom portion of the first cavity 40. A second inner ring 11 protruding inward toward the second cavity 41 is formed on the housing 1. The first inner ring 42 abuts against the second inner ring 11. The swinging head 21 sequentially passes through the second inner ring 11 and the first inner ring 42. A gap 12 is formed between the swinging head 21 and the second inner ring 11 and the first inner ring 42.

In above structures, the cavity 20 is divided into the second cavity 41 and the first cavity 40 arranged front and rear. The first inner ring 42 and the second inner ring 11 are arranged at a junction of the first cavity 40 and the second cavity 41. The first inner ring 42 and the second inner ring 11 narrow an inner wall of the cavity 20, thereby reducing the gap 12, When the vibrating diaphragm 2 vibrates, a vibrating airflow is generated in the second cavity 41 first, and then transmitted to the first cavity 40, and finally acts on the human body. Under cooperation of the second cavity 41, the first cavity 40, the first inner ring 42, and the second inner ring 11, the vibrating airflow is buffered, and discomfort caused by vibrating airflow in the second cavity 41 is avoided, thereby significantly improving the use experience.

In actual use, based on arrangements of the two cavities, the sucking action is soft and the discomfort caused by strong air pressure changes is avoided.

In the embodiment, a vibrating disc 22 is formed at a center of a bottom portion of the vibrating diaphragm 2. The swinging head 21 is close to an edge of the vibrating disc 22. Furthermore, the swinging head 21 is inclined at a predetermined angle with respect to the vibrating diaphragm 2.

The swinging head 21 is arranged obliquely and the swinging head 21 is arranged at an eccentric position of the vibrating disc 22, so that when the vibrating diaphragm 2 vibrates, the swinging head 21 not only performs a telescopic movement, but also performs a left-right movement, which makes an effect of mechanical vibration wave generated by the swinging head 21 good. Therefore, the swinging head 21 imitates the tongue vividly. In actual use, the swinging head 21 may be in a shape of a tongue, or in other shapes such as a fusiform.

Figure 6:
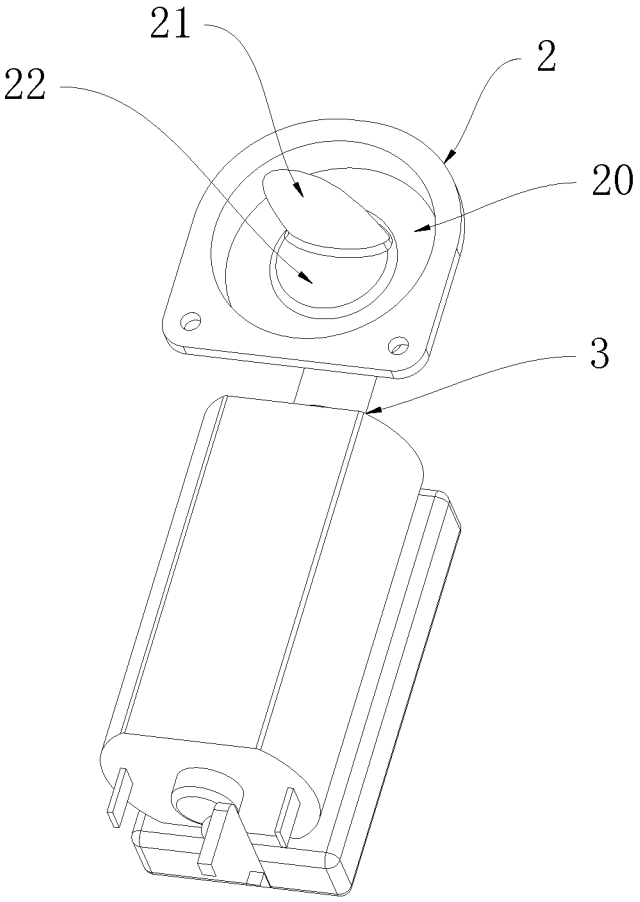
FIG. 6 is a schematic diagram of a vibrating driving mechanism and a vibrating diaphragm.
Figure 7:
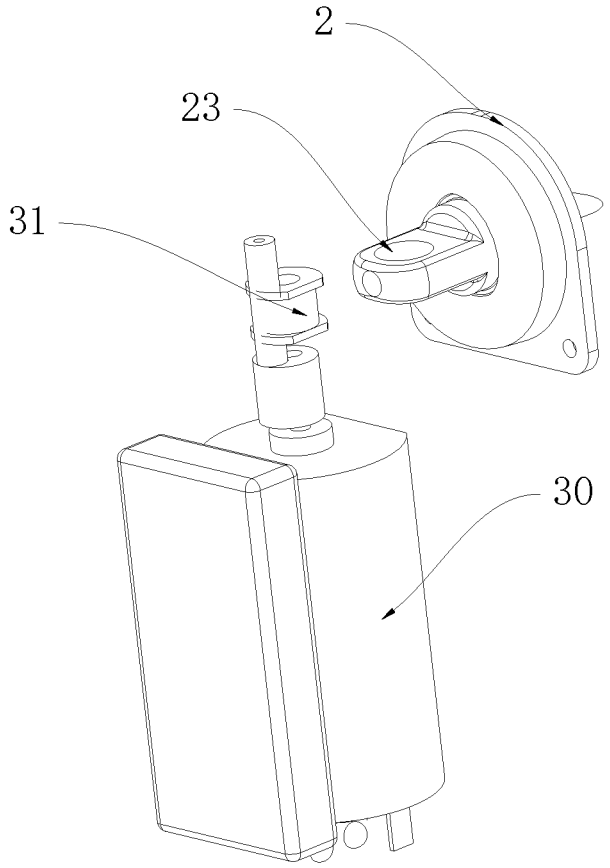
FIG. 7 is another schematic diagram of a vibrating driving mechanism and a vibrating diaphragm.
Figure 8:
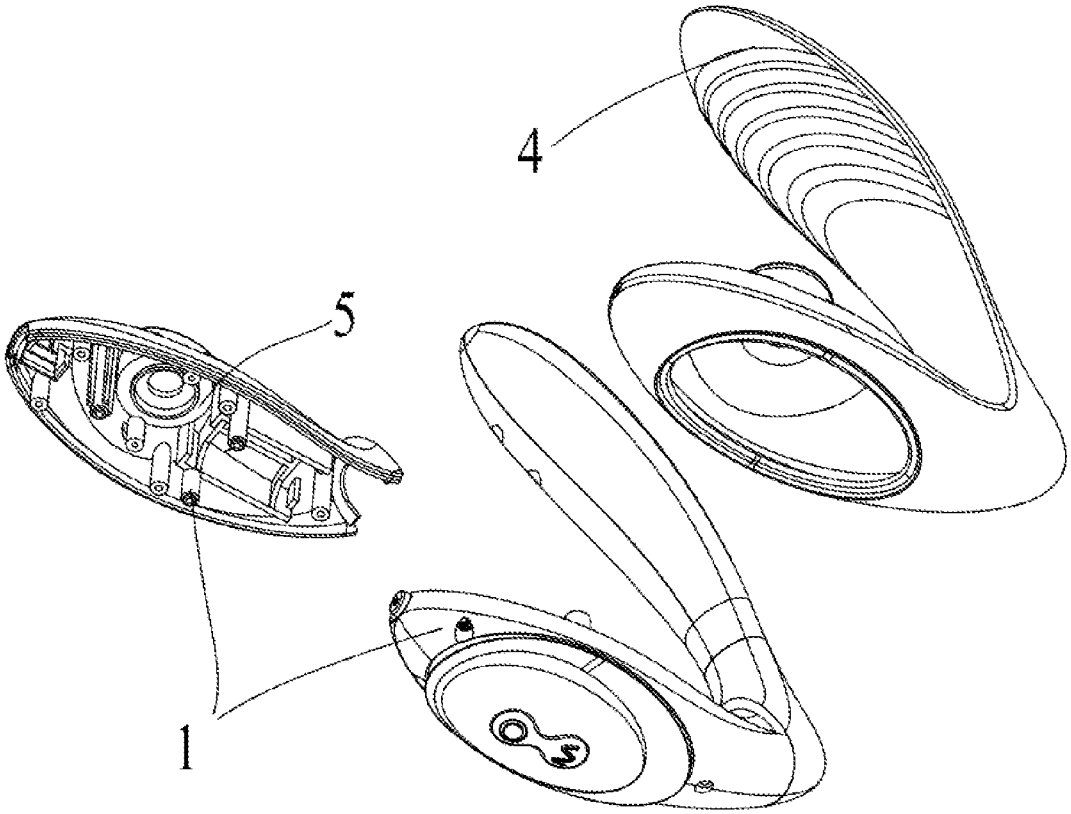
FIG. 8 is an exploded perspective view of the female masturbation device of the present disclosure.

Regarding a specific structure of the vibrating driving mechanism 3, in the embodiment, as shown in FIG. 6 and FIG. 7, the vibrating driving mechanism 3 comprises a vibrating motor 30. An eccentric wheel 31 is arranged on an output shaft of the vibrating motor 30. A connecting arm 23 is formed on a back side of the vibrating disc 22. The connecting arm 23 is sleeved on the eccentric wheel 31 and is closely connected with the eccentric wheel 31. When the vibrating motor 30 is running, the eccentric wheel 31 drives the connecting arm 23 and the vibrating diaphragm 2 reciprocate.

Figure 5:
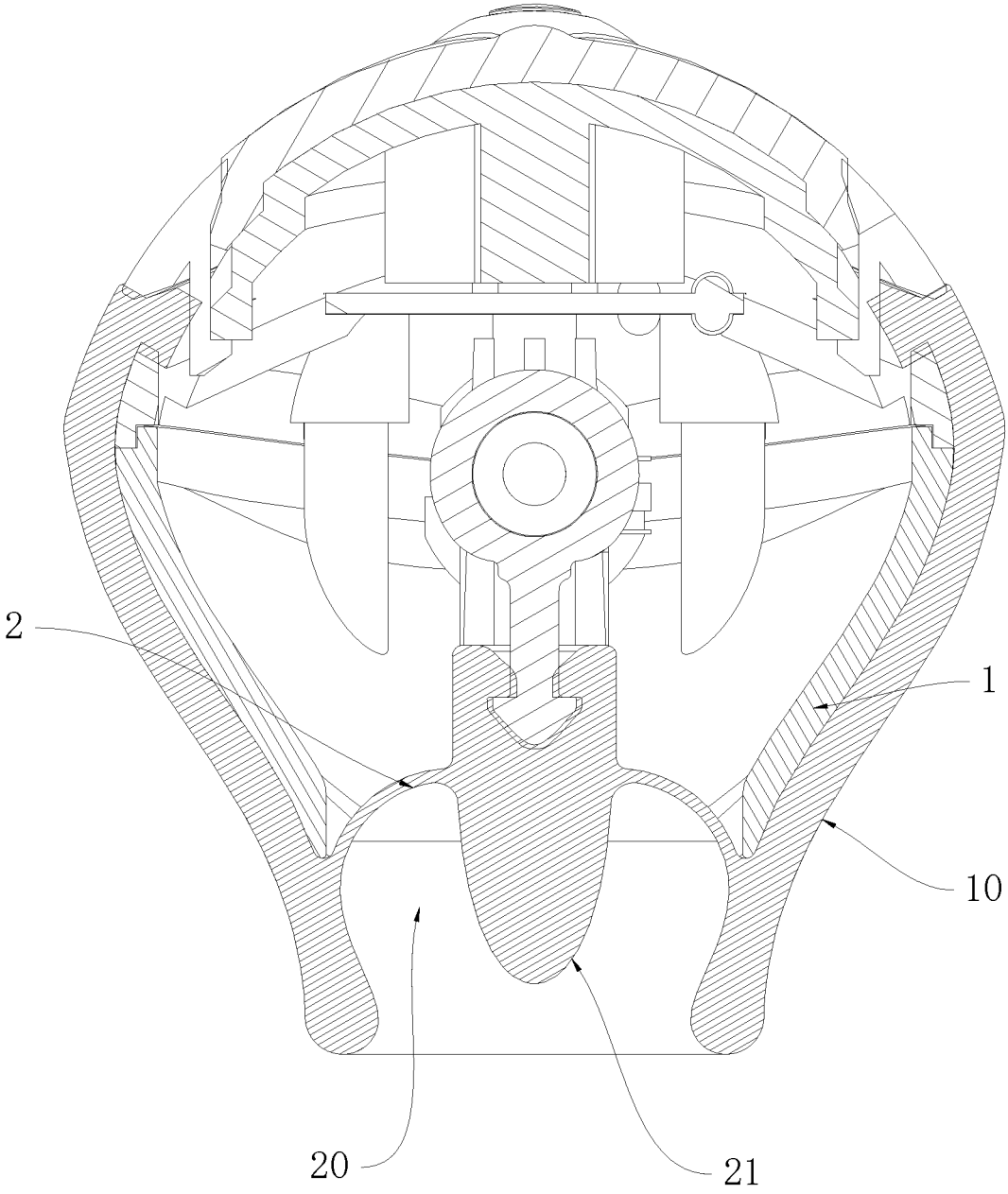
FIG. 5 is a cross-sectional view of the female masturbation device according to another embodiment of the present disclosure.

In another embodiment of the present disclosure, as shown in FIG. 5, a silicone sleeve 10 is sleeved on an outer side of the housing 1. The silicone sleeve 10 is recessed toward the housing 1 to form the cavity 20. The vibrating diaphragm 2 is integrally formed with the bottom portion of the cavity 20.

In order to cooperate with the body to be massaged, a convex ring 24 protruding outward is formed on an edge of the opening of the cavity 20.

The above structures make the vibrating diaphragm 2 and the silicone sleeve 10 into an integral structure, which is not only simple in structure, but also easy to manufacture and low in cost.

Foregoing descriptions are only optional embodiments of the present disclosure and are not intended to limit the present disclosure. Any modification, equivalent replacement, or improvement within the technical scope of the present disclosure should be included in the protection scope of the present disclosure.

What is claimed is:

1. A female masturbation device, comprising:

a housing, wherein a cavity is arranged in the housing;

a vibrating diaphragm is arranged on a bottom portion of the cavity, the vibrating diaphragm is fixedly connected to the bottom portion of the cavity or integrally formed with the bottom portion of the cavity;

a vibrating driving mechanism is arranged inside the housing, the vibrating driving mechanism is configured to drive the vibrating diaphragm to reciprocate;

a swinging head is formed on the vibrating diaphragm, the swinging head extends along a direction of an opening of the cavity;

a first cavity recessed inward is formed on a sleeve;

a second cavity is formed between the housing and the vibrating diaphragm;

wherein the first cavity is communicated with the second cavity to form the cavity;

a first inner ring protruding inward is formed on a bottom portion of the first cavity;

a second inner ring protruding inward toward the second cavity is formed on the housing; wherein the first inner ring abuts against the second inner ring; the swinging head sequentially passes through the second inner ring and the first inner ring; and a gap is formed between the swinging head and the second inner ring and the first inner ring.

2. The female masturbation device according to claim 1, wherein a diaphragm pressing plate is fixed in the housing, the diaphragm pressing plate is pressed against an edge of the vibrating diaphragm to fix the vibrating diaphragm to the bottom portion of the cavity.

3. The female masturbation device according to claim 2, wherein an outer side of the housing is wrapped with the sleeve made of a soft rubber.

4. The female masturbation device according to claim 1, wherein a vibrating disc is formed at a center of a bottom portion of the vibrating diaphragm; the swinging head is close to an edge of the vibrating disc.

5. The female masturbation device according to claim 4, wherein the vibrating driving mechanism comprises a vibrating motor; an eccentric wheel is arranged on an output shaft of the vibrating motor; a connecting arm is formed on a back side of the vibrating disc; the connecting arm is sleeved on the eccentric wheel and is closely connected with the eccentric wheel; when the vibrating motor is running, the eccentric wheel drives the connecting arm and the vibrating diaphragm reciprocates.

6. The female masturbation device according to claim 1, wherein the sleeve is a silicone sleeve that is sleeved on an outer side of the housing; the silicone sleeve is recessed toward the housing to form the cavity; the vibrating diaphragm is integrally formed with the bottom portion of the cavity.

7. The female masturbation device according to claim 6, wherein a convex ring protruding outward is formed on an edge of the opening of the cavity.

* * * * *